US005695433A

United States Patent [19]

Buisman

[11] Patent Number: 5,695,433

[45] Date of Patent: Dec. 9, 1997

[54] VARIABLE HEIGHT BODY SUPPORT FOR EXERCISE APPARATUS

[75] Inventor: Stanley R. Buisman, Brooklyn Park, Minn.

[73] Assignee: NordicTrack, Inc., Chaska, Minn.

[21] Appl. No.: 634,548

[22] Filed: Apr. 18, 1996

Related U.S. Application Data

[63] Continuation of Ser. No. 979,729, Nov. 19, 1992, abandoned.

[51] Int. Cl.[6] ..... A63B 22/00

[52] U.S. Cl. ..... 482/70; 482/908

[58] Field of Search ..... 482/51, 57, 62, 482/70, 58, 908, 907, 54, 148

[56] References Cited

U.S. PATENT DOCUMENTS

| | | | |
|---|---|---|---|
| 4,531,730 | 7/1985 | Chenera | 482/907 |
| 4,573,678 | 3/1986 | Lamb et al. | 482/907 |
| 4,709,918 | 12/1987 | Grinblat | 482/908 |
| 4,781,372 | 11/1988 | McCormack | 482/908 |
| 5,026,049 | 6/1991 | Goodman | 482/907 |
| 5,178,593 | 1/1993 | Roberts | 482/62 |

*Primary Examiner*—Stephen R. Crow

*Attorney, Agent, or Firm*—Charles E. Steffey

[57] ABSTRACT

The present invention provides an exercise apparatus having a stabilizing device pivotally mounted relative to the frame of the exercise apparatus. A bolt is rotatably mounted relative to the frame at a fixed distance from the pivot point of the stabilizing device, and a nut is threaded onto the bolt. The stabilizing device is rotatably mounted relative to the nut at a point intermediate the pivot point and a body support member on the stabilizing device.

16 Claims, 4 Drawing Sheets

VARIABLE HEIGHT BODY SUPPORT FOR EXERCISE APPARATUS

This is a continuation of application Ser. No. 07/979,729, filed Nov. 19, 1992, now abandoned.

FIELD OF THE INVENTION

The present invention relates to exercise equipment and more particularly, to a variable height abdomen support such as the type used on a cross-country ski machine.

BACKGROUND OF THE INVENTION

Exercise generally involves the transmission of force or energy from the body of the person exercising to another object. In performing activities such as running and cross-country skiing, a person drives his or her feet downward and rearward into the ground to propel himself or herself forward. The runner or skier maintains his or her balance as the leg drive is translated into forward momentum.

If a person wishes to simulate activities such as running and skiing on exercise apparatus designed for such purposes, then a counterbalance is required for the reactive force that would otherwise be converted into forward momentum. Although a person may be able to remain stationary and balanced on some such equipment where the resistance to leg drive is relatively small, most treadmills, cross-country ski machines, and other types of striding apparatus provide structure that assists a person in maintaining his or her balance while exercising. Some examples of such structure include hand rails, poles, and abdomen supports.

NordicTrack, Inc. of Chaska, Minn. manufactures and sells cross-country ski machines that include an abdomen support against which a person leans while exercising. NordicTrack recognizes that the elevation of the abdomen support must be adjustable to accommodate people of various heights and body types, and NordicTrack has addressed this need. In one prior art embodiment, the abdomen support is slidably mounted on a vertical post and releasably secured anywhere along the post by one or more bolts or pins. In another prior art embodiment, the abdomen support is rotatably mounted relative to a post and releasably secured in one of several discrete orientations by a bolt or pin. However, despite the strides that have been made to date to address this concern, a need still exists for an abdomen support that effectively and efficiently accommodates people of all heights and body types within a wide range of heights.

SUMMARY OF THE INVENTION

The present invention provides a variable height stabilizing device of a type that secures to the frame of an exercise apparatus to enable a person to stabilize himself or herself relative to the exercise apparatus. The stabilizing device includes a body supporting means for supporting some portion of the person's body, and a pivoting means for pivotally connecting the body supporting means to the frame of the exercise apparatus. The stabilizing device also includes a retaining means for retaining the body supporting means in any orientation within a continuous range of orientations relative to the frame of the exercise apparatus. In a preferred embodiment, the stabilizing device further includes an orientation adjusting means for adjusting the orientation of the body supporting means relative to the frame, and range adjusting means for allowing a person to select between alternative pivot points and thereby adjust the continuous range of orientations.

According to another embodiment, the present invention provides an exercise apparatus having a body support member pivotally mounted to the frame of the exercise apparatus at a pivot point. A bolt is rotatably mounted to the frame at a fixed distance from the pivot point, and a nut threaded onto said bolt. The body support member is rotatably mounted to the nut, and in a preferred embodiment, the body support member is selectively pivotally mounted to the frame at one of a plurality of available pivot points. Also, in a preferred embodiment, the exercise apparatus is a cross-country ski machine having a pair of foot supports that are slidably mounted to the frame, and the body support member includes a pad designed to engage the abdomen of a person standing on the pair of foot supports.

The present invention provides an effective and efficient method and apparatus for adjusting the relative elevation of an abdomen support. The abdomen support can be raised and lowered using a single hand and without any strength requirement. Also, the combination of the continuous range and the availability of multiple continuous ranges functions to accommodate people of all heights and body types within a wide range of heights. Those skilled in the art will recognize these and other advantages upon a more detailed description of a preferred embodiment.

BRIEF DESCRIPTION OF THE DRAWING

With reference to the Figures, wherein like numerals represent like parts throughout the several views.

DETAILED DESCRIPTION OF A PREFERRED EMBODIMENT

Figure 4:
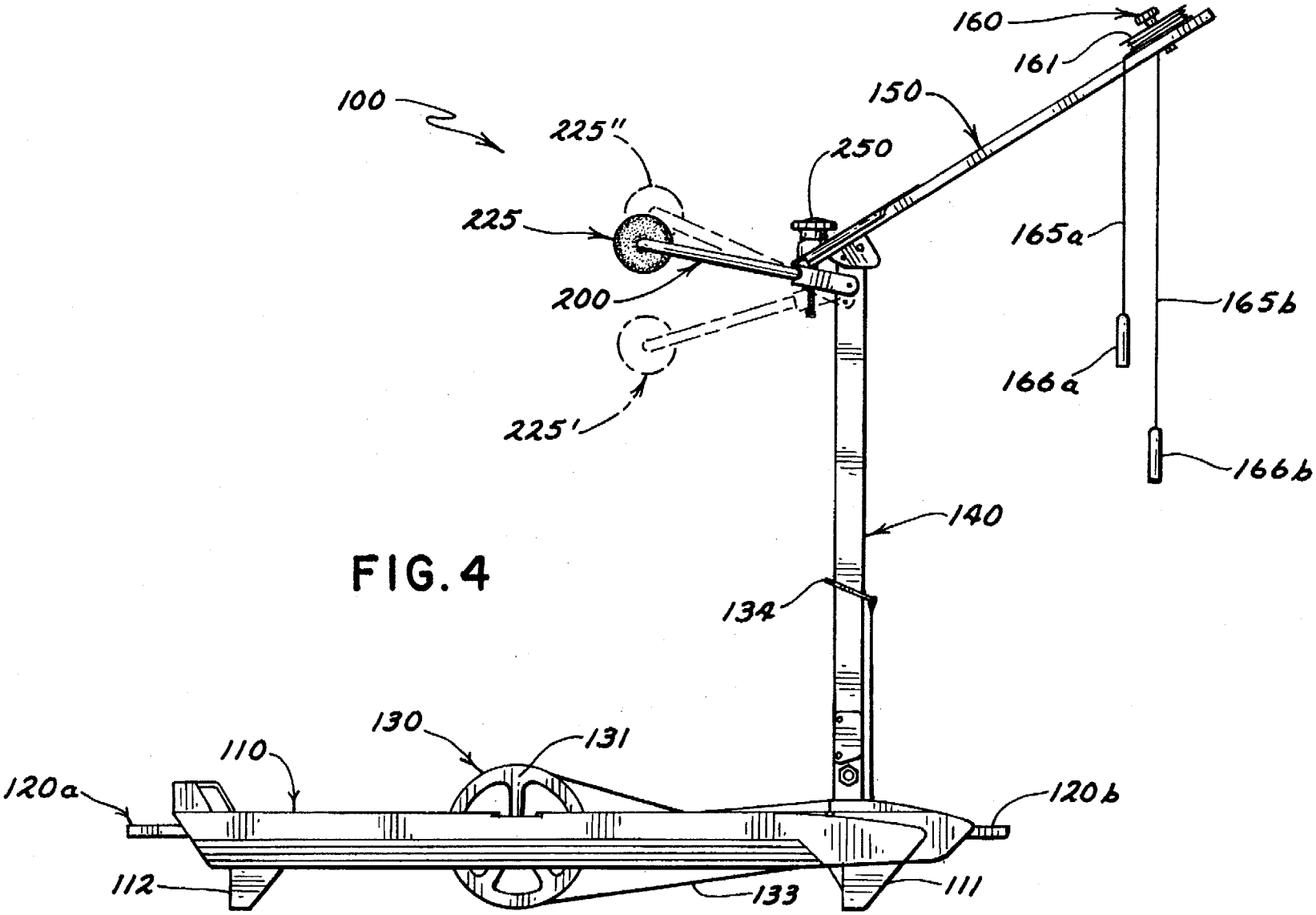
FIG. 4 is a side view of a cross-country ski machine including the stabilizing device shown in FIG. 1.

A preferred embodiment cross-country ski machine constructed according to the principles of the present invention is designated as 100 in FIG. 4. The ski machine 100 includes a base 110 having a front leg assembly 111 and a rear leg assembly 112 that are designed to rest upon a floor surface. A pair of simulator skis 120*a* and 120*b* are slidably mounted relative to the base 110. Each of the skis 120*a* and 120*b* extends from a respective front end to a respective rear end and has a respective toe loop mounted on a respective intermediate portion therebetween. A resistance means 130 is operatively connected to the base 110 and the skis 120*a* and 120*b*, such that the skis 120*a* and 120*b* slide relative to the base 110 subject to resistance provided by the resistance means 130.

The resistance means 130 includes a flywheel 131 that rotates subject to frictional forces between the circumference of the flywheel 131 and a drag strap 133 secured about the circumference of the flywheel 131. The exercise apparatus 100 further includes a post 140 that is rotatably mounted relative to the base 110 and extends in a substantially vertical direction from the base 110 when in an operable position. A clip 134 is slidably mounted relative to the post 140 to releasably secure the drag strap 133 relative to the post 140 and thereby set the tension in the drag strap 133 and the corresponding level of resistance to rotation of the flywheel 131.

The ski machine 100 further includes an abdomen support or stabilizing device 200 that is rotatably mounted relative to the post 140. The abdomen support 200 is designed to support the hips of a person using the apparatus 100,and the elevation of the abdomen support 200 is adjustable to accommodate persons of various heights, as will be discussed in greater detail below. A bar 150 is rotatably mounted relative to the post 140 and extends in a forward and upward direction from the post 140 when in an operable position, defining an angle of approximately 130 degrees therebetween.

An arm exerciser unit 160 is secured relative to a distal end of the bar 150. The arm exerciser unit 160 includes a pair of lines 165*a* and 165*b* that are designed to be pulled from a drum 161 in reciprocating fashion subject to a frictional resistance force. A pair of handles 166*a* and 166*b* are disposed on respective distal ends of the pair of lines 165*a* and 165*b*.

In operating the ski machine 100, a person faces toward the abdomen support 200, places a foot on each of the skis 120*a* and 120*b*, and leans forward to rest his or her hips or abdomen against the abdomen support 200. The person may additionally grasp a handle in each hand or simply hold onto the sides of the abdomen support 200. The person then "shuffles" his or her feet back and forth, alternately pushing one of the skis 120*a* and 120*b* rearward against the resistance from the flywheel 131 and pulling the other of the skis 120*a* and 120*b* forward against minimal resistance. The person also has the option of alternately pulling one of the handles 166*a* and 166*b* rearward against the resistance from the drum 161 and having the other of the handles 166*a* and 166*b* reciprocally pulled forward.

Figure 1:
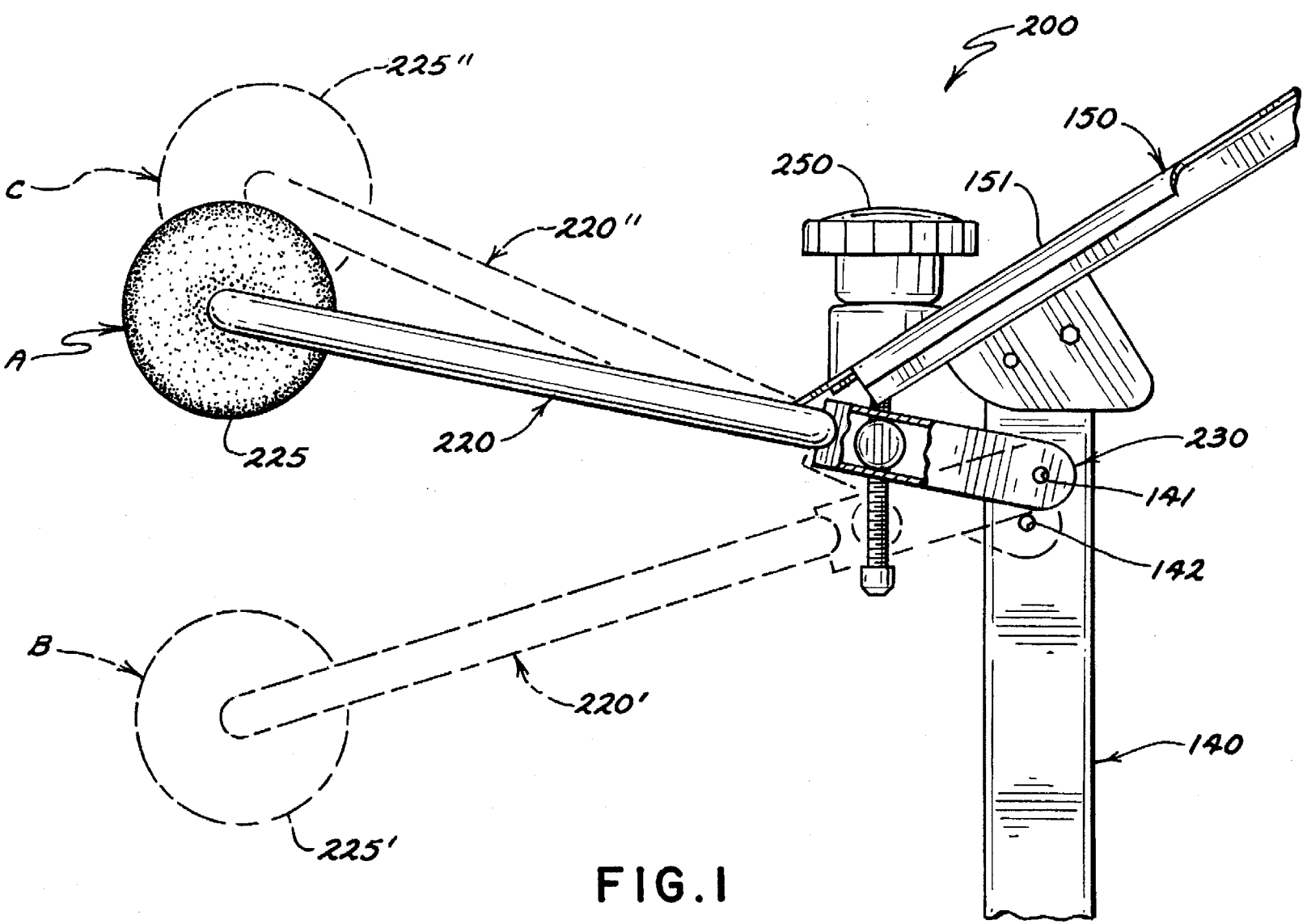
FIG. 1 is a side view of a preferred embodiment stabilizing device constructed according to the principles of the present invention.
Figure 2:
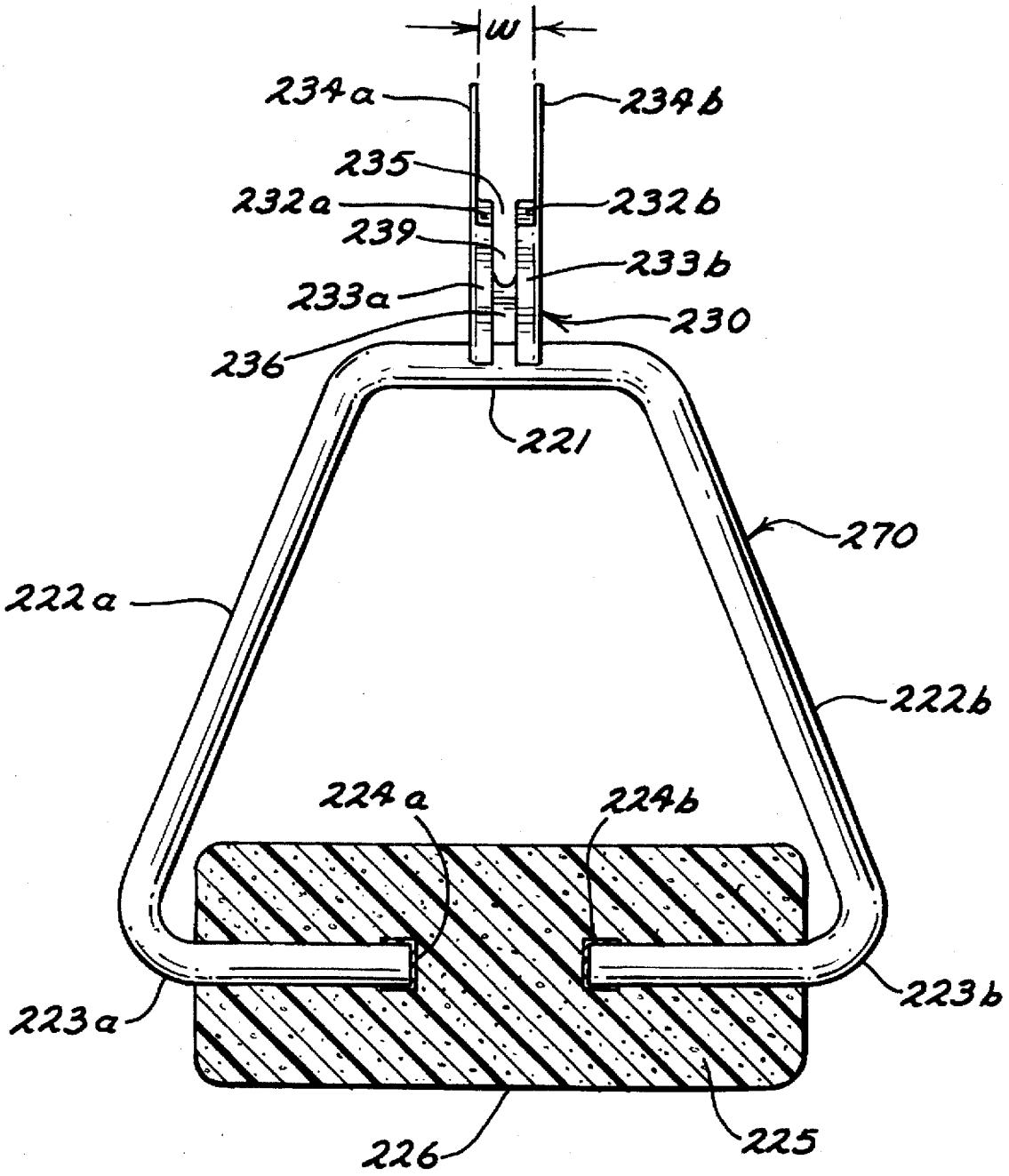
FIG. 2 is a bottom view of a portion of the stabilizing device shown in FIG. 1.
Figure 3:
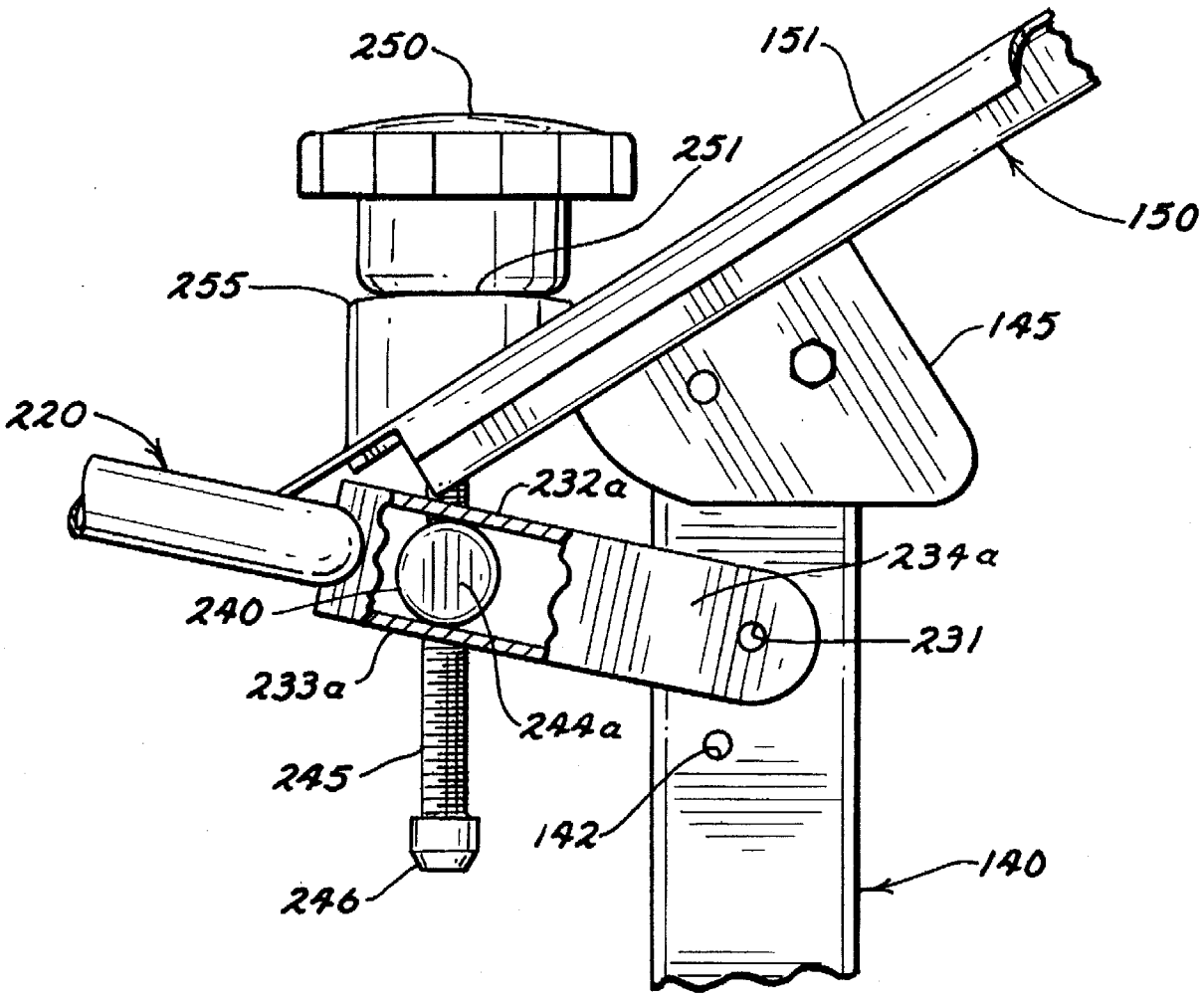
FIG. 3 is an enlarged side view of a portion of the stabilizing device shown in FIG. 1.

The abdomen support or stabilizing device 200 is shown in greater detail in FIGS. 1–3. The abdomen support 200 includes a retaining means or linking member 230 that secures a body supporting means or body support member 220 relative to the ski machine 100. The retaining means 230 has a first end that is pivotally mounted relative to the post 140 by means of a pin that inserts through a hole 231 in the linking member 230 and a corresponding hole 141 through the post 140. The retaining means 230 has a second end that is rigidly secured to the body support member 220.

The body support member 220 includes an inner transverse member 221, side members 222*a* and 222*b*, and outer transverse members 223*a* and 223*b*. The inner transverse member 221 is rigidly secured to the retaining means 230. The side members 222*a* and 222*b* are integrally joined to opposite ends of the inner transverse member 221 and define adjacent angles of approximately 110 degrees relative thereto. The side members 222*a* and 222*b* function as a stabilizing device to the extent that they are designed to grasped by the hands of a user who elects not to use the arm exerciser unit 160.

The outer transverse members 223*a* and 223*b* are integrally joined to respective side members 222*a* and 222*b* and define adjacent angles of approximately 70 degrees relative thereto. The outer transverse members 223*a* and 223*b* and the inner transverse member 221 are disposed on opposite ends of the stabilizing device 200. Also, the various members of the body support member 220 are substantially co-planar and combine to define a trapezoid wherein the transverse members are parallel to one another.

The outer transverse members 223*a* and 223*b* have distal ends that face one another and are spaced apart a sufficient distance to allow mounting of a support pod 225 thereon. The pad 225 has bored ends that are designed to mount onto the distal ends of the outer transverse members 223*a* and 223*b*. Recognizing that the length of the pad 225 is greater than the distance between the distal ends, the pad 225 is squeezed into position and effectively captured between the distal ends. In a preferred embodiment, the pad 225 has a cylindrical body engaging surface 226 that extends approximately 11 inches in the direction defined by its cylindrical axis. Additionally, caps 224*a* and 224*b* may be placed over the respective distal ends to prevent the ends from damaging the pad 225. The pad 225 functions as a stabilizing device to the extent that it provides a support against which a user leans while striding.

The bar 150 has an integral shoulder 255 proximate its pivoting end 151, which shoulder 255 provides a substantially horizontal bearing surface 251 when the bar 150 is in an operable position. A bolt 245 extends through a hole in the bearing surface 251 and is connected to a knob 250 that is disposed directly above the bearing surface 251. The knob 250 and the bolt 245 are rotatable as a unit relative to the shoulder 255 and thus, relative to the frame of the exercise apparatus. The bolt 245 has a longitudinal axis that extends at a fixed distance from the pivot point 141.

The bolt 245 has external threads designed to mate with internal threads on a nut 240, which is threaded onto the bolt 245. The nut 240 and the bolt 245 are disposed between the pivoting end of the abdomen support 200 and the opposite, pad bearing end of the abdomen support 200 . The nut 240 is cylindrical in shape and has a cylindrical axis that is perpendicular to the longitudinal axis of the bolt 245 when the nut 240 is threaded onto the bolt 245. In other words, the internal threads on the nut 240 are disposed along a bore extending diametrically through the cylindrical nut 240. A cap 246 is secured to a distal end of the bolt 245 to prevent the nut 240 from coming off the bolt 245 and to cover any sharp edges on the distal end of the bolt 245.

The body support member 220 is rotatably and slidably mounted relative to the nut 240 in the manner discussed below. The linking member 230 includes right and left sidewalls 234*a* and 234*b* that extend the entire length of the linking member 230 to define a channel 239 therebetween. The top of the channel 239 is bounded by a top pair of opposing flanges 232*a* and 232*b* which are integrally joined to respective sidewalls 234*a* and 234*b* and define a top slot 235 therebetween. The bottom of the channel 239 is bounded by a bottom pair of opposing flanges 233*a* and 233*b* which are integrally joined to respective sidewalls 234*a* and 234*b* and define a bottom slot 236 therebetween. The widths of the slots 235 and 236 are greater than the diameter of the bolt 245, so that the bolt 245 can slide into and out of the slots 235 and 236, or conversely, the channel portion of the linking member 230 can slide onto and off of the bolt 245.

The width W of the channel 239 is greater than the length of the nut 240, as measured along the cylindrical axis of the nut 240, and the height H of the channel 239 is greater than the diameter of the nut 240. As a result, where the longitudinal axis of the channel 239 is perpendicular to the cylindrical axis of the nut 240 and thus, the plane defined by the axes of the nut 240 and the bolt 245, the nut 240 can slide into and out of the channel 239, or conversely, the channel portion of the linking member 230 can slide onto and off of the nut 240. Although larger, the dimensions of the channel 239 approximate the dimensions of the nut 240, such that the ends of the nut 240, one of which is shown and designated as 244*a* in FIG. 3, adjoin the sidewalls 234*a* and 234*b* of the channel 239. In other words, the relative dimensions of the channel 239 and the nut 240 are such that the nut 240 is "caged" by the channel 239 and constrained to occupy a fixed orientation relative to the bolt 245 and thus, the frame of the exercise apparatus.

In operation of the stabilizing device, rotation of the knob 250 causes the nut 240 to travel along the bolt 245, which in turn causes the body support member 220 to rotate about the pivot point 141. As such, the nut 240 and bolt 245 combination function as a means for adjusting the orientation of the body support member 220 relative to the frame of the exercise apparatus. Also, the orientation adjusting means combines with the pivoting means to function as the means for retaining the body support member in any orientation relative to the frame of the exercise apparatus. The extremes of one such continuous range of orientations are designated as A and B in FIG. 1.

The available continuous range of orientations can be selectively varied by moving the pivot point of the stabilizing device 200 to an alternative pivot point, such as the hole 142 formed in the post 140. In other words, when the first end of the retaining means 230 is pivotally mounted at a lower point on the post 140 (by means of a pin that inserts through a hole 231 in the linking member 230 and an alternative hole 142 through the post 140 ), the upper end of the range of continuous orientations is raised to the upper extreme designated as C in FIG. 1.

With respect to the preferred embodiment shown in FIG. 4, the present invention provides a method of securing the abdomen support 220 at any desired elevation within a continuous range of elevations relative to the cross-country ski machine 100. A person need only turn the knob 250 until the abdomen support 220 arrives at the desired elevation. As a result, the abdomen support 220 can be raised and lowered using only one hand and without any strength requirement. Additionally, the person may pivotally mount the abdomen support 220 at an alternative pivot point on the cross-country ski machine 100 and thereby select a different continuous range of pivoting. The combination of the continuous range and the availability of multiple continuous ranges effectively and efficiently accommodates people of all heights and body types within a wide range of heights.

The present invention has been described with reference to a preferred embodiment cross-country ski machine. However, those skilled in the art will recognize a variety of modifications and applications that fall within the scope of the present invention. For example, the present invention is not limited to the particular cross-country ski machine shown in FIG. 4 but rather, is applicable to all types of striding apparatus, as well as exercise equipment in general. As another example, the nut 240 need be only effectively cylindrical in shape, meaning only the portion of the nut 240 that engages the retaining means 230 need be cylindrical to effect rotation of the retaining means 230 relative to the nut 240. Accordingly, the present invention is to be limited only by the appended claims.

What is claimed is:

1. An exercise apparatus comprising: a frame; a body support member pivotally mounted to said frame at a pivot point; a bolt rotatably mounted to said frame at a fixed distance from said pivot point; and a nut, effectively cylindrical in shape and having an effective cylinder axis that is perpendicular to the longitudinal axis of said bolt; wherein said bolt nut is threaded onto said bolt, and wherein said body support member includes a channel that effectively cages said nut, with said channel having a longitudinal channel axis that is perpendicular to a plane containing said effective cylinder axis and the longitudinal axis of said bolt.

2. A variable height stabilizing device of a type that secures to the frame of an exercise apparatus to enable a person to stabilize himself or herself relative to the exercise apparatus, comprising:

body supporting means for supporting some portion of the person's body;

pivoting means for pivotally connecting said body supporting means to the frame of the exercise apparatus;

retaining means for retaining said body supporting means in any orientation within a continuous range of orientations relative to the frame of the exercise apparatus; said retaining means includes a bolt that is rotatably mounted to the frame, such that a longitudinal axis of said bolt remains at a fixed distance from a point of pivoting defined by said pivoting means, and said retaining means further including a nut that is threaded onto said bolt, wherein said body supporting means is rotatably mounted to said nut; and said pivoting means including a pin that inserts through holes formed in said body supporting means and the frame of the exercise apparatus, and said body supporting means includes a pad having a cylindrical body engaging surface that extends at least eight inches in a direction perpendicular to a plane of pivoting defined by said pivoting means, and said nut and said bolt are disposed between said pin and said pad.

3. A variable height stabilizing device according to claim 2, with said nut being effectively cylindrical in shape and having an effective cylinder axis that is perpendicular to the longitudinal axis of said bolt when said nut is threaded onto said bolt.

4. A variable height stabilizing device according to claim 3, wherein said body support member includes a channel that effectively cages said nut, and said channel has a longitudinal channel axis that is perpendicular to a plane containing said effective cylinder axis and the longitudinal axis of said bolt.

5. A variable height stabilizing device according to claims 2, further comprising a knob secured to said bolt, wherein said knob and said bolt are rotatable as a unit relative to said frame.

6. A variable height stabilizing device according to claims 4, further comprising a knob secured to said bolt, wherein said knob and said bolt are rotatable as a unit relative to said frame.

7. A variable height stabilizing device of a type that secures to the frame of an exercise apparatus to enable a person to stabilize himself or herself relative to the exercise apparatus, comprising: a body supporting means for supporting some portions of the person's body; a pivoting means for pivotally connecting said body supporting means to the frame of the exercise apparatus; and, retaining means for retaining said body supporting means in any orientation within a continuous range of orientations relative to the frame of the exercise apparatus, wherein said retaining means includes a bolt that is rotatably mounted to the frame, such that a longitudinal axis of said bolt remains at a fixed distance from a point of pivoting defined by said pivoting means, and said retaining means further includes a nut that is threaded onto said bolt, wherein said body supporting means is rotatably mounted to said nut with said nut being effectively cylindrical in shape and having an effective cylinder axis that is perpendicular to the longitudinal axis of said bolt when said nut is threaded onto said bolt said nut located between said point of pivoting and said body supporting means.

8. A variable height stabilizing device according to claim 7, wherein said pivoting means includes a pin insertable through corresponding holes formed in said body supporting means and the frame of the exercise apparatus for the purpose of adjusting the height of the body supporting means.

9. A variable height stabilizing device according to claim 7, wherein said body supporting means includes a channel that effectively cages said nut, and said channel has a longitudinal channel axis that is perpendicular to a plane containing said effective cylinder axis and the longitudinal axis of said bolt.

10. An exercise apparatus, comprising:

a frame;

a body support member having first and second ends, with the first end pivotally mounted to said frame at a pivot point;

a bolt rotatably mounted to said frame at a fixed distance from said pivot point;

a nut threaded onto said bolt, wherein said body support member is rotatably mounted to said nut;

a pair of foot supports that are slidably mounted to said frame; and a pad included with said body support member for engaging the body of a user of said exercise apparatus while the user is standing on said pair of foot supports.

11. An exercise apparatus according to claim 10, wherein said pad is supported at said second end of said body support member.

12. An exercise apparatus according to claim 11, wherein said nut and said bolt are disposed between said first end and said second end of said body support member.

13. An exercise apparatus according to claim 10, wherein said body support member is selectively pivotally mounted to said frame at one of a plurality of available pivot points.

14. An exercise device according to claim 13, wherein the body support member is selectively pivotally mounted to said frame by a pin insertable through corresponding holes formed in said body supporting means and the frame of the exercise apparatus for the purpose of adjusting the height of the body supporting means.

15. An exercising device according to claims 10 or 14, with said nut being effectively cylindrical in shape and having an effective cylinder axis that is perpendicular to the longitudinal axis of said bolt when said nut is threaded onto said bolt.

16. An exercising device according to claim 15, wherein said body support member includes a channel that effectively cages said nut, and said channel has a longitudinal channel axis that is perpendicular to a plane containing said effective cylinder axis and the longitudinal axis of said bolt.

* * * * *